US007617545B2

(12) United States Patent
Martin

(10) Patent No.: US 7,617,545 B2
(45) Date of Patent: Nov. 17, 2009

(54) NOISE SUPPRESSION FLUSH CARTRIDGE FOR PRESSURE ASSISTED TOILET

(75) Inventor: Raymond Bruce Martin, Bloomfield Hills, MI (US)

(73) Assignee: Water Control Technology Corporation, Birmingham, MI (US)

( * ) Notice: Subject to any disclaimer, the term of this patent is extended or adjusted under 35 U.S.C. 154(b) by 0 days.

(21) Appl. No.: 11/957,179

(22) Filed: Dec. 14, 2007

(65) Prior Publication Data

US 2009/0151062 A1 Jun. 18, 2009

(51) Int. Cl.
*E03D 3/10* (2006.01)

(52) U.S. Cl. ..... 4/354; 4/359

(58) Field of Classification Search ..... 4/353, 4/354, 361, 362, 359
See application file for complete search history.

(56) References Cited

U.S. PATENT DOCUMENTS 3,817,286 A * 6/1974 Caron et al. ..... 4/354
4,233,698 A * 11/1980 Martin ..... 4/354
5,361,426 A * 11/1994 Martin ..... 4/361
5,652,969 A * 8/1997 Taylor ..... 4/354
RE37,921 E * 12/2002 Martin et al. ..... 4/361

* cited by examiner

*Primary Examiner*—Tuan N Nguyen
(74) *Attorney, Agent, or Firm*—Rader, Fishman & Grauer, PLLC

(57) ABSTRACT

An apparatus for initiating a flush of a pressure assisted toilet includes a generally cylindrical housing having a top end, a bottom end, an internal surface and a discharge aperture having a first predetermined area. The apparatus also includes a first member at least partially interposed within the housing and having a plurality of apertures formed therein; a second member at least partially interposed within the housing and having a generally cylindrical hollow body with a top opening, a tapered upper portion adjacent the top opening, a sealing portion, and a lower extension defining a lower opening; a stem portion extending at least partially through the first member and the second member; and a first flow path extending at least from the bottom end of the housing, through at least one of the plurality of apertures formed in the first member, and through the lower opening of the second member.

21 Claims, 17 Drawing Sheets

| Category<br>Test # | Gerber Ultra w/Flushmate III<br>2007 Std.<br>11-2807-1b | V1.10<br>11-2607-2b | % Std, | V1.21<br>11-2807-2b | % Std, |
|---|---|---|---|---|---|
| Test Pressure [psi] | 50 | 50 | | 50 | |
| Histogram Readings | 50 | 105 | | 105 | |
| Noise Emissions [50 psi] | | | | | |
| Peak db [Avg of 5 Cycles] | 86.0 | 82.2 | 96% | 83.8 | 97% |
| Emissions above 60 dB | 54% | 23% | | 24% | |
| Time t Reach Peak dB [sec] | 1.2 | 2.8 | 133% | 3.2 | 167% |
| dB Acceleration Rate/sec | 38.3 | 15.4 | 40% | 10.4 | 27% |
| Flush Duration > 60 dB [sec] | 4.7 | 4.9 | 104% | 5.0 | 106% |
| Flush Duration >80 dB [sec] | 1.6 | 1.0 | 63% | 0.8 | 50% |
| Extraction [25 psi] | | | | | |
| ANSI Balls [# Out] | 100 | 100 | 100% | 100 | 100% |
| MaP Cylinders [# Out] | 25 | 25 | 100% | 25 | 100% |

FIG. 18

NOISE SUPPRESSION FLUSH CARTRIDGE FOR PRESSURE ASSISTED TOILET

TECHNICAL FIELD

The present invention relates to a pressure assisted toilets, and more specifically to a flush cartridge of a flushometer-tank which activates a pressure assisted toilet.

BACKGROUND

A pressure assisted toilet system typically includes a pressure tank, such as a flushometer tank, a supply system and a flush cartridge. The supply system typically includes a backflow preventor and a pressure regulator to ensure that the pressure tank is maintained below a desired pressure. The pressure tank is fully sealed and maintains the supply pressure during refilling after each flush. This supply pressure, typically 45-55 pounds per square inch gauge (psig), pressurizes the pressure tank to its prescribed level and provides a motive force for a subsequent flush of a toilet bowl. Prior art pressure assisted toilet systems are found in U.S. Pat. Nos. 4,223,698; 5,361,426, 6,360,378 and RE37,921 the disclosures of which are hereby incorporated by reference in their entireties.

FIG. 1 illustrates a prior art pressure assisted toilet system 20. System 20 is normally encased in an outer china housing 22, a pressure tank 24 (such as disclosed in U.S. Pat. No. 5,802,628) having a discharge outlet 28 and an inlet 30, and a flush valve cartridge 36. Flush valve cartridge 36 includes a flush valve 38 having a seal 40, a top flange 42, and an escape hole 44 formed therein, a flush valve stem 46 interposed through the escape hole 44, a flush valve spring 48, a generally cylindrical jacket 50, a lower inlet 52 positioned between the jacket 50 and the discharge outlet 28, and a actuation portion 54. Seal 40 of flush valve 38 seats against discharge outlet 28 in order to allow pressure tank 24 to fill with water. The flush valve stem 46 includes a flush valve enlargement 60 that selectively seals with a portion of the flush valve 38. The top flange 42 is dimensioned so as to provide a small amount of clearance between an outer edge of the top flange 42 and the generally cylindrical inner surface of the jacket 50. When filled with water, the tank 24 is typically pressurized above atmospheric pressure.

To flush system 20, the actuation portion 54 is depressed toward the flush valve 38 which urges the valve stem 46 downward, which permits water (and/or air) to flow through escape hole 44, thereby reducing the pressure above flush valve 38 within cartridge 36. With this pressure reduced, flush valve 38 is forced upward by the pressure differential created between the tank 24 and the area above the flush valve 38 as water flows between the outer edge of the top flange 42 and the jacket 50. That is, the pressure differential across the top flange 42 will overcome the force of the flush valve spring 48 to lift the flush valve 38. As the flush valve 38 lifts, water is discharged through discharge outlet 28. Generally, the flush valve 38 will lift entirely out of the discharge outlet 28 (above the surface that the seal 40 contacts) during each flush to permit a maximum volumetric flow through the discharge outlet 28. After a majority of the water is discharged from the tank 24, the pressure differential across the top flange 42 is reduced and the flush valve spring 48 urges the flush valve to return to a sealing engagement with the discharge outlet 28.

While the ability of a prior art pressure assisted toilet flush system to extract waste is unmatched, a disadvantage is that the noise generated during flushing has been considered undesirably loud. As a result, this has restricted its use in residential applications where excessive noise is undesirable. This noise is partially due to the rapid change in water flow rate, cavitation, and flow direction. What is needed, therefore, is a pressure assisted toilet system that controls the flow of water in such a way that noise is reduced to more acceptable levels.

BRIEF DESCRIPTION OF THE DRAWINGS

Referring now to the drawings, illustrative embodiments are shown in detail. Although the drawings represent some embodiments, the drawings are not necessarily to scale and certain features may be exaggerated, removed, or partially sectioned to better illustrate and explain the present invention. Further, the embodiments set forth herein are exemplary and are not intended to be exhaustive or otherwise limit or restrict the claims to the precise forms and configurations shown in the drawings and disclosed in the following detailed description.

FIG. 18 is a summary chart of FIGS. 10, 11, and 17.

DETAILED DESCRIPTION

Figure 2:
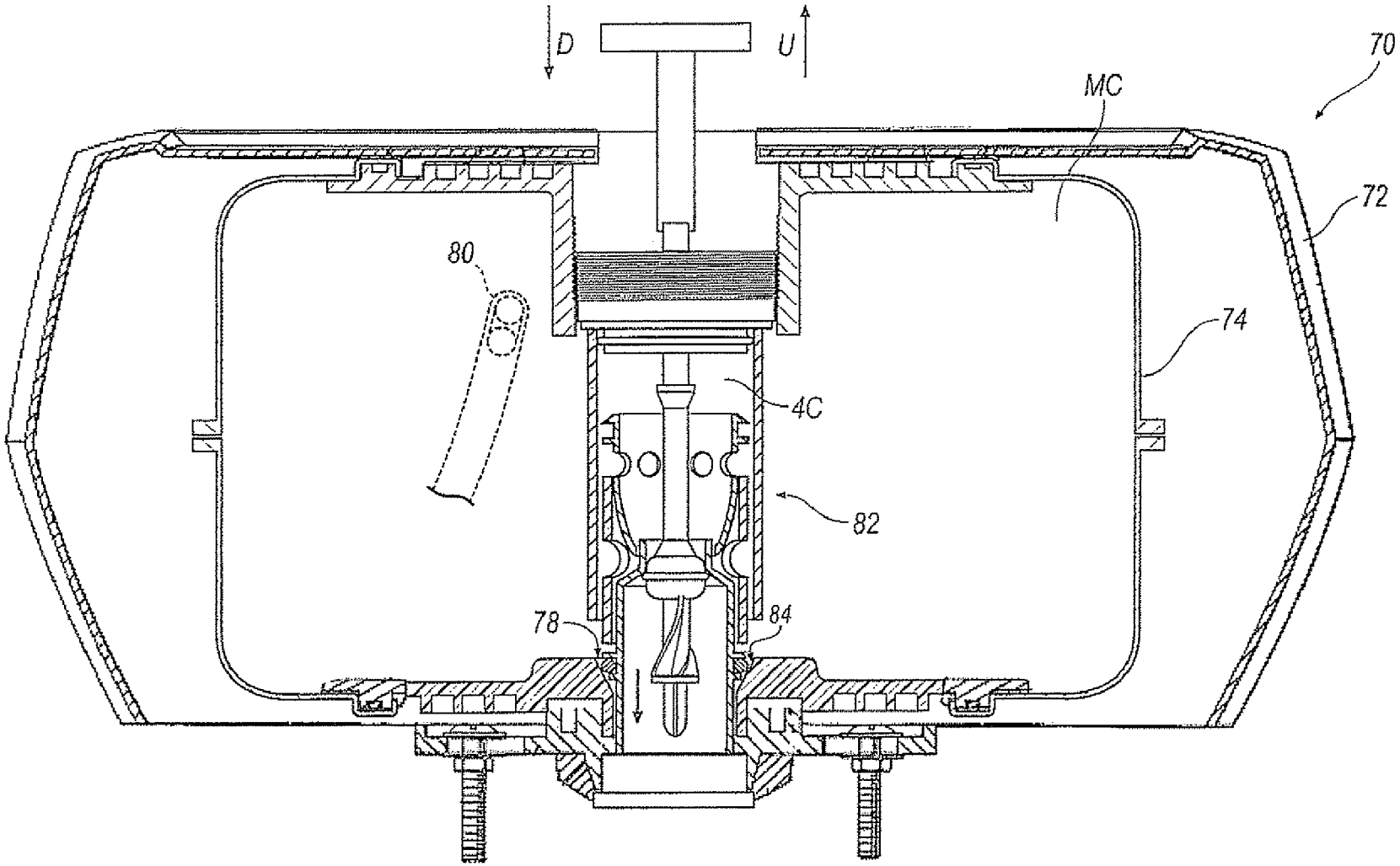
FIG. 2 is a partial sectional elevation view of a pressure assisted flush system including a flush cartridge.

FIG. 2 illustrates a pressure assisted toilet flush system 70 in accordance with an embodiment. The system 70 includes a vessel, or pressure tank, 74 having a main chamber MC, a discharge outlet 78 and an inlet 90, and a flush cartridge 82. Discharge outlet 78 is preferably defined in part by a frusto-conical interior surface 84 and a generally cylindrical surface 86, as discussed below. In the embodiment illustrated, the tank 74 is a flushometer tank With reference to FIGS. 2-6, flush cartridge 82 includes a jacket, or outer housing, 88, a first member, or flush valve 92, a second member, or muffler portion 90, a top cap 94, a stem 96, and an actuation member 98. Both the muffler portion 90 and the flush valve 92 are slidably interposed within the jacket 100. In the embodiment illustrated, the jacket 100 is coupled to the top cap 94 such that no relative movement is permitted. The stem 96 extends through the top cap 94, as best seen in FIG. 3, and is axially moveable relative thereto.

The housing 88 includes a cylindrical body (or jacket) 100, generally defined by an axis A-A, which extends from a top end 102 to a bottom end 104, and an internal surface 106. Top end 102 may define a larger inside diameter than bottom end 104, and internal surface 106 may be accordingly tapered from top end 102 to bottom end 104. The top end 102 is coupled to the top cap 94, while the bottom end 104 defines a lower jacket opening 108.

Figure 4:
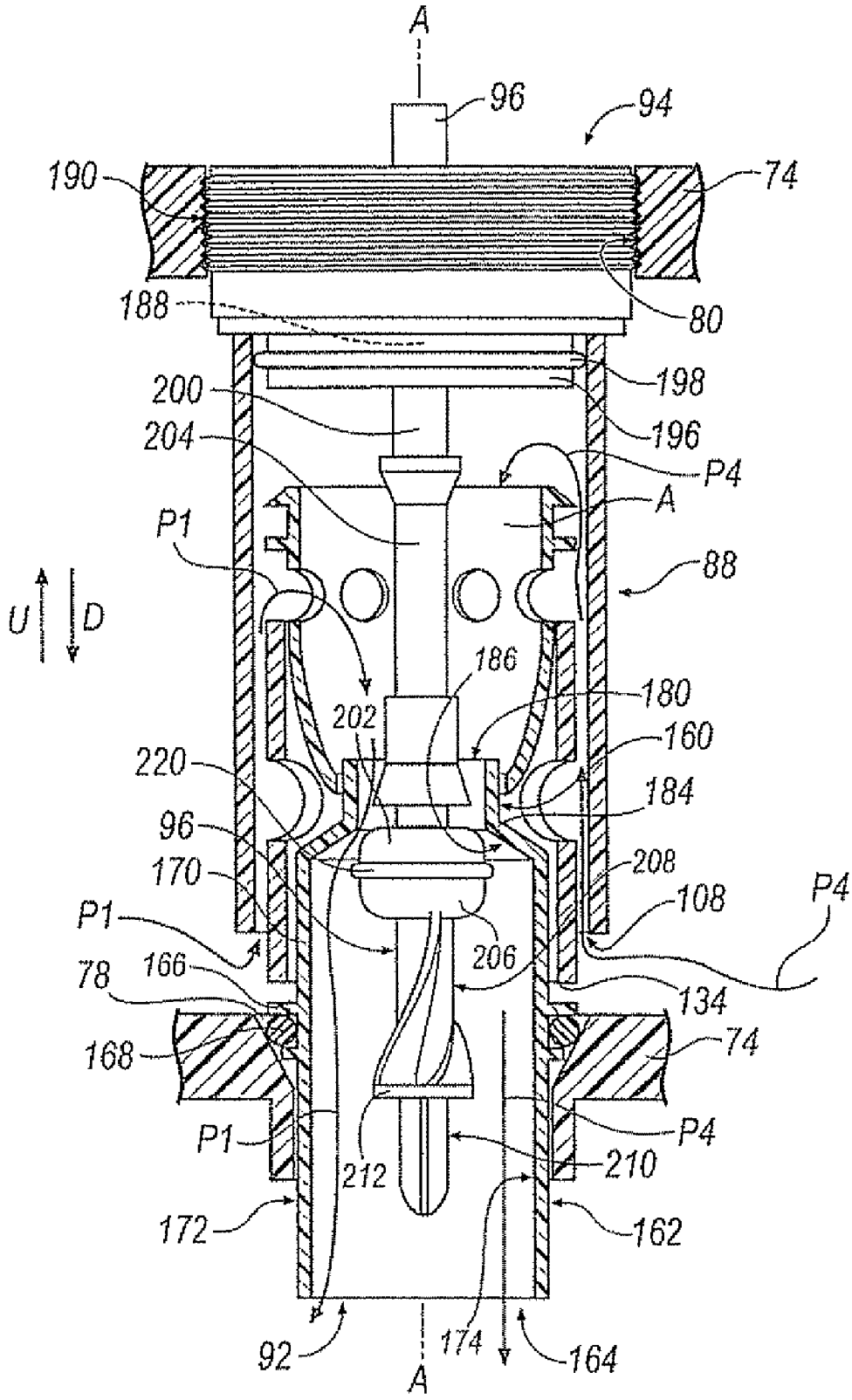
FIG. 4 is an enlarged partial sectional elevation view of a portion of FIG. 2.
Figure 5:
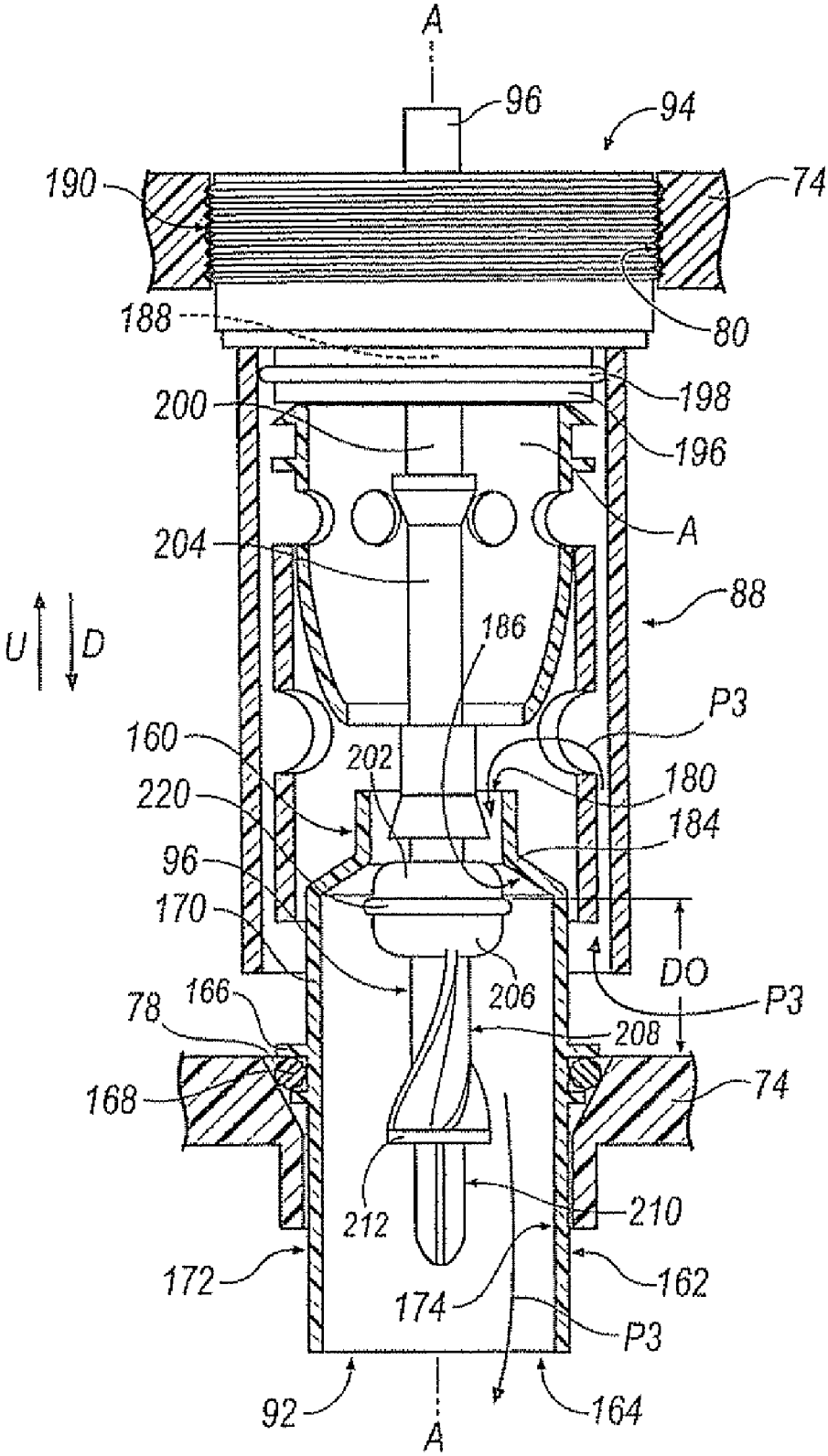
FIG. 5 is a sectional view of the flush cartridge of FIG. 3, illustrated in a second configuration.
Figure 7:
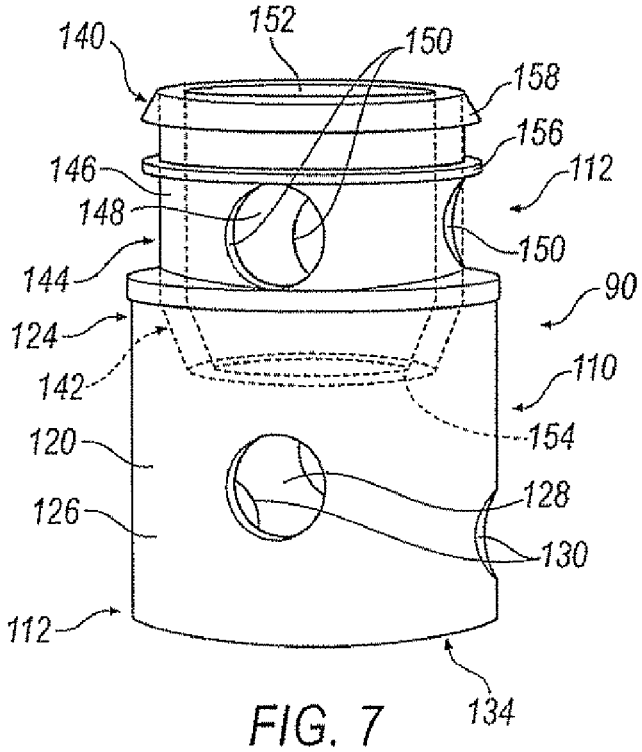
FIG. 7 is a perspective view of a portion of FIG. 2.

The muffler portion 90, as best seen in FIG. 7, includes a lower muffler portion 110 and an upper muffler portion 112. The lower muffler portion 110 includes a generally cylindrical hollow muffler body 120 having a lower end 122 an upper end 124, an outer surface 126, and inner surface 128, a plurality of apertures 130 formed between surfaces 126 and 128, and a lower muffler opening 134. The upper muffler portion 112 includes a first end 140, a second end 142, a central portion 144, a first surface 146, a second surface 148, a plurality of apertures 150 formed between surfaces 146 and 148, an upper opening 152, a lower opening 154, a lower flange 156, and an upper flange 158. The second end 142 of the upper muffler portion 112 is converges inwardly and is at least partially interposed within the upper end 124 of the lower muffler portion 110. The outer diameter of the muffler portion 90 is less than the inner diameter of the outer jacket 100, as best seen in FIGS. 3-5.

Figure 3:
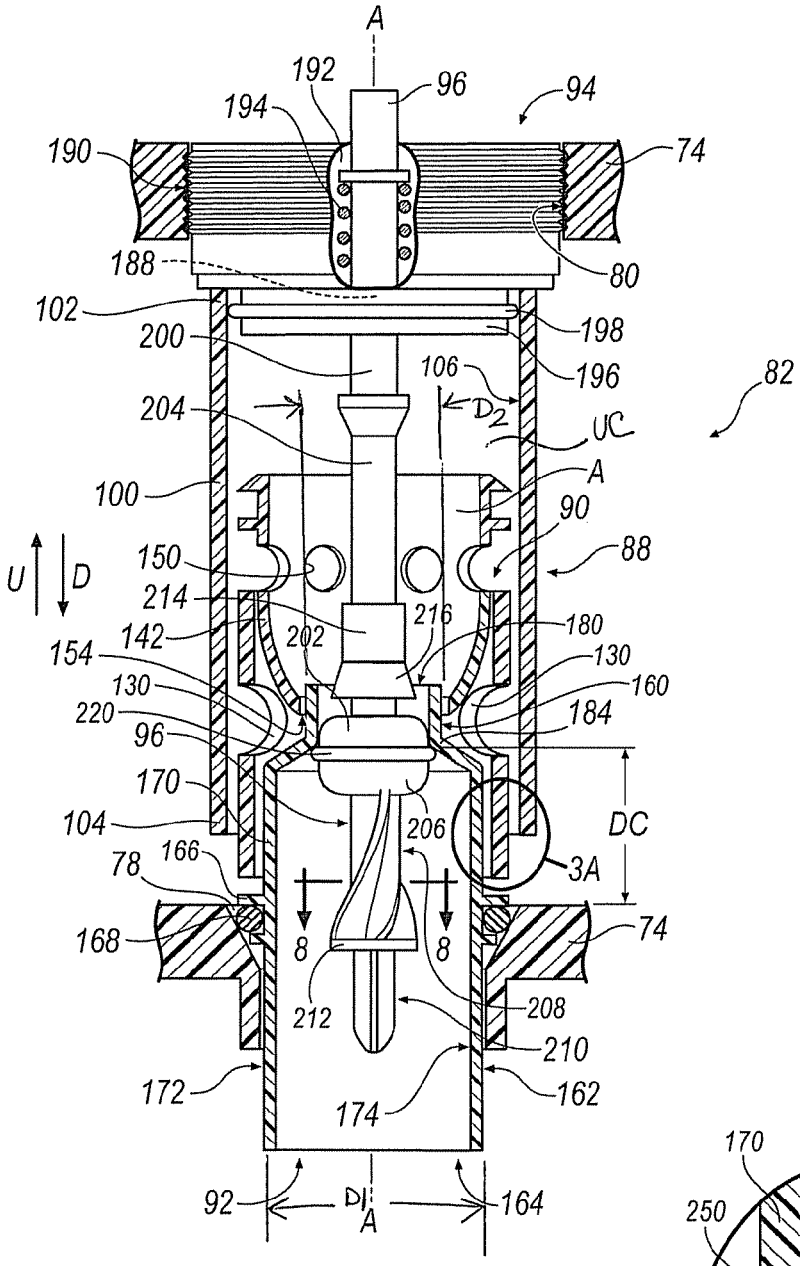
FIG. 3 is an enlarged partial sectional elevation view of a portion of FIG. 2.

As best seen in FIG. 3, an upper chamber UC is located between the lower opening 154 and the top cap 94. The apertures 130, 150 may be of any shape and number, although generally circular apertures are illustrated.

The flush valve 92 includes an main body valve end 160, a extension portion 162 defining a lower opening 164, a seal retaining portion 166, a seal 168, a generally cylindrical hollow central flush valve body 170 extending therebetween, an outer surface 172, and an inside surface 174. The main body valve end 160 includes a top opening 180, a generally cylindrical upper portion 182 defined by the top opening 180, and a tapered upper portion 184 adjacent the top opening 180 and interconnecting the upper portion 182 with the central flush valve body 170. The tapered upper portion 184 includes a generally frusto-conical inside stem sealing surface 186. In the embodiment illustrated, the seal 168 is a conventional o-ring that is restrained within seal retaining portion 166 and extending radially therefrom in sealing contact with discharge outlet 78 when flush valve 92 is closed (FIGS. 2-5), as discussed in greater detail below. In the embodiment illustrated, the outer surface 172 of the central flush valve body 170 defines a predetermined diameter D1. Also in the embodiment illustrated, the outer surface 172 of the extension portion 162 defines a predetermined diameter D2. The dimension of the diameter D1 may be generally the same as the dimension of the diameter D2, as desired.

Figure 6:
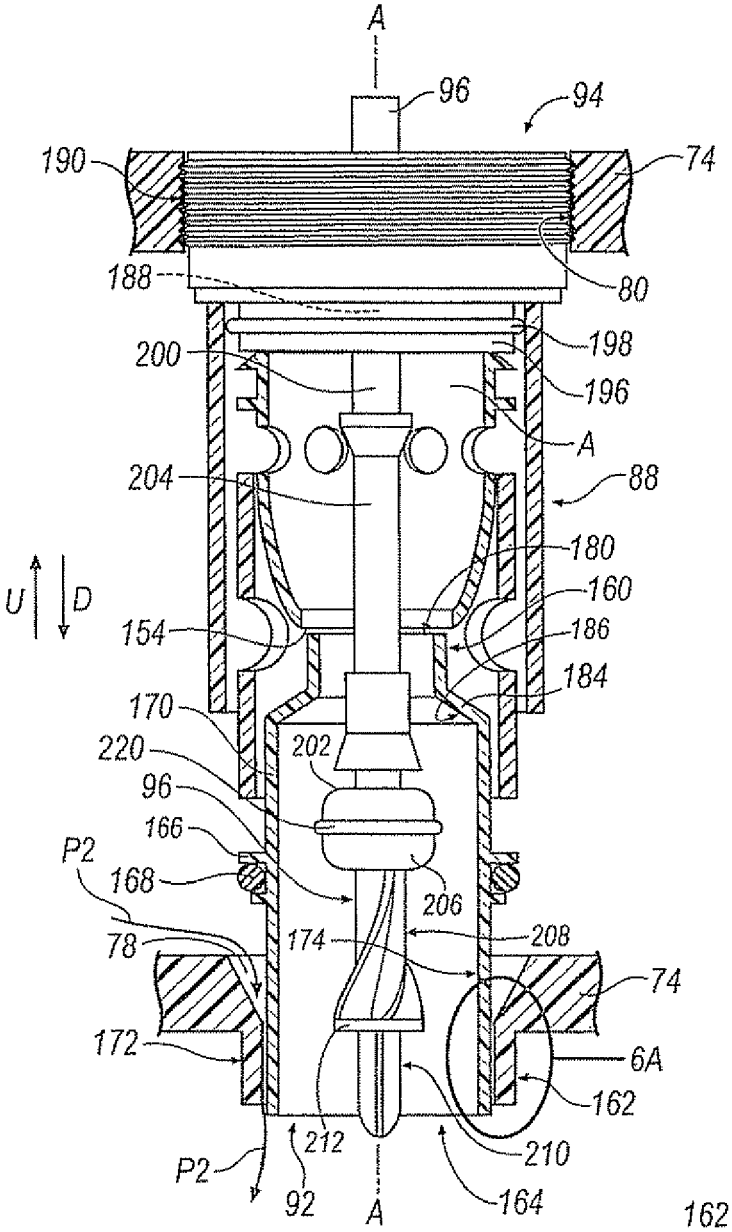
FIG. 6 is a sectional view of the flush cartridge of FIG. 3, illustrated in a third configuration.

Both the muffler portion 90 and the flush valve 92 are essentially free-floating within the jacket 100, as restrained by the jacket 100 and the stem 96. AS best seen in FIGS. 4-6, the muffler portion 90 and the flush valve 92 will move axially within the jacket 100, generally along the axis A-A.

In the embodiment illustrated, the top cap 94 includes a stem seal 188, a threaded outer surface 190, a central bore 192 a biasing member 194, and a top cap lower end 196 having an o-ring 198 coupled thereto. The biasing member 194 may be a coil spring that biases the stem 96 generally in the direction of the arrow U of FIG. 3.

The stem 96 includes a first stem portion 200 that extends through the central bore 192, a diverting portion 202, a central portion 204 connecting the first stem portion 200 to the diverting portion 202, a stem sealing portion 206, a second stem portion 208, a third stem portion 210, a connector portion 212 interconnecting the second stem portion 208, and the third stem portion 210, a stem expanded portion 214, and a stem flair 216. In the embodiment illustrated, the stem sealing portion 206 includes an o-ring 220 extending therefrom and adapted to seat with the stem sealing surface 186. The stem expanded portion 214 and the stem fair 216 are positioned above the diverting portion 202 to reduce the flow therepast.

Figure 8:
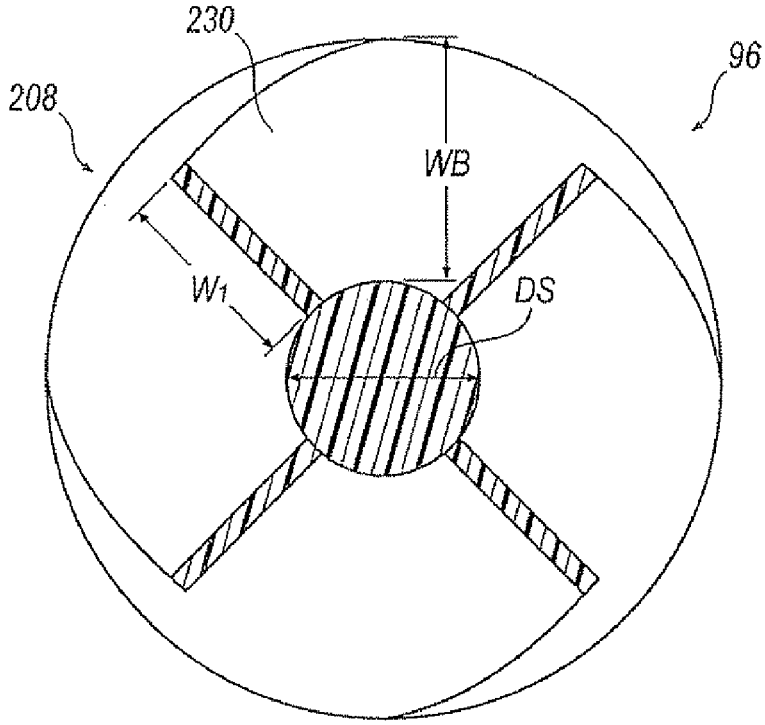
FIG. 8 is partial sectional view taken along cut line 8-8 of FIG. 3.

With specific reference to FIGS. 3 and 8, the second stem portion 208 is illustrated with a plurality of helical blades 230 formed thereon. The helical blades 230 are illustrated in FIG. 8 with a generally rectangular section, although any suitable section may be formed. The effective width of helical blades 230 increases as the helical blades 230 extend below the stem sealing portion 206. As best seen in FIG. 8, the helical blades 230 have an effective width W1 at the cut line 8-8 of FIG. 3. Further, the helical blades 230 have an effective width WB at the connection with the connector portion 212. As best seen in FIG. 3, the helical blades 230 begin below the stem sealing portion 206 and taper to the width W2 at the connector portion 212. The width WB is greater than width W1, which is greater than the width of the helical blades 230 at the interface between the stem sealing portion 206 and the first portion 208. in the embodiment illustrated, the helical blades 230 are not intended to significantly reduce the flow of water. As illustrated, the pitch of the helical blades is between about one inch (1 in., or about 2.54 millimeters) and about 2 in (5.08 mm). That is, the distance between adjacent helical blades 230, measured parallel to the axis A-A, is between about 1 in. and about 2 in. The connector portion 212 is illustrated as a generally cylindrical disk, although the connector portion 212 may be eliminated in other embodiments.

Figure 3A:
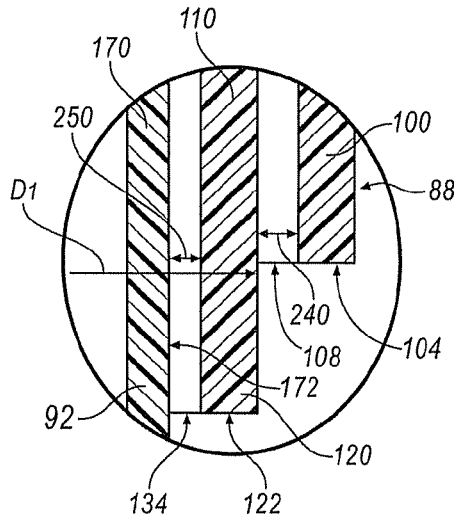
FIG. 3A is an enlarged partial sectional elevation view of a portion of FIG. 3.

As best seen in FIGS. 3 and 3A, in an embodiment where the jacket 100, the muffler body 120 and the flush valve body 170 are generally cylindrical, a first annular gap 240 spans the distance between the internal surface 106 of the jacket 100 and the outer surface 126 of the muffler body 120. Also, a second annular gap 250 spans the distance between the inner surface 128 of the muffler body 120 and the outer surface 172 of the flush valve body 170.

Figure 6A:
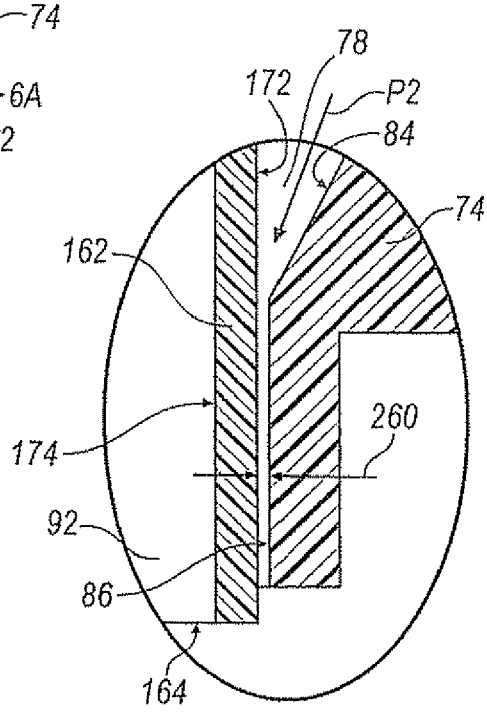
FIG. 6A is an enlarged partial sectional elevation view of a portion of FIG. 6.

As best seen in FIGS. 6 and 6A, a third annular gap 260 spans the distance between the outer surface 172 of the extension portion 162 of the flush valve 92 and the surface 86 of the outlet 78. The third annular gap is dimensioned so as to reduce the maximum discharge flow rate, as discussed in greater detail below. As discussed in greater detail below, the helical blades 230 impart a vortex, or swirling effect, within the water discharged from pressure tank 74 through the inside surface 174 of the extension portion 162 of the flush valve body 170.

When installed within a toilet (not shown), system 70 is filled with water through inlet 80. Typical residential water pressure ranges from about 40 psi to about 60 psi, while the American National Standard Institute (ANSI) A112.19.2 is 20-80 psi. In the embodiment illustrated, a pressure relief valve (not shown) is located in the water line between a water source (not shown) and inlet 80 to restrict inlet water pressure to the desired pressure (usually around 25 psig). After filling, vessel 74 (including the interior A of the jacket 100 (best seen in FIGS. 3, 4, 5 and 6), which includes upper chamber UC) is pressurized to the inlet water pressure setting. This tank pressure urges seal 168 into a binding contact with discharge outlet 78 and the stem sealing portion 206 into a binding contact with the stem sealing surface 186. A distance between the sealing contact and seal retaining portion 168 is defined as DC in FIG. 3. During a filling when vessel 74 and flush cartridge 82 are initially dry, the air within pressure tank 74 main chamber MC and upper chamber UC is compressed. During subsequent flushes, the main chamber MC and the upper chamber UC may contain compressed air.

As best seen in FIG. 4, a first flow path P1 extends at least from the bottom end 104 of the jacket 100, between the outer surface 126 of the muffler portion 90 and the internal surface 106 of the jacket 100 (through the first annular gap 240), through at least one of the plurality of apertures 130 formed in the upper muffler portion 112, and through the lower opening 164 of the flush valve 92. As best seen in FIG. 6A, a second flow path P2 extends from the main chamber MC, between the outer surface 172 of the extension portion 162 of the flush valve 92 and the surface 86 of the discharge outlet 78 (through the third annular gap 260), and through the discharge outlet 78. As best seen in FIG. 5, a third flow path P3 extends at least from the bottom end 104 of the jacket 100, between the outer surface 126 of the muffler portion 90 and the internal surface 106 of the jacket 100, through at least one of the plurality of apertures 100 formed in the lower muffler portion 110, and through the flush valve 92, from the top opening 180 to the lower opening 164. As best seen in FIG. 4, a fourth flow path P4 extends at least from the bottom end 104 of the jacket 100, between the outer surface 126 of the muffler portion 90 and the internal surface 106 of the jacket 100, between the lower flange 156 and the upper flange 158 of the upper muffler portion 112 and the internal surface 106 of the jacket 100, through the muffler portion 90 from the upper opening 152 to the top opening 180 of the flush valve 92, and through the lower opening 164 of the flush valve 92.

As best seen in FIG. 6, interference between the top cap 94, the muffler portion 90, and the flush valve 92 will prevent the extension portion 162 of the flush valve 92 from lifting above the surface 86 of the discharge outlet 78. That is, the flow of water between the extension portion 162 and the discharge outlet 78 will flow through the third annular gap 260.

In one embodiment of operation, a user will depress the actuation member 98 in the direction of the arrow D causing the stem 96 to move in the direction of arrow D, as generally seen in FIG. 4. Movement of the stem 96 in the direction of the arrow D will cause the stem sealing portion 206 to unseat from the stem sealing surface 186. A distance between a top edge of sealing member 220 and a top portion of the pressure tank 74 may be defined as DO. When the stem sealing portion 206 unseats from the stem sealing surface 186, at least a portion of the compressed fluid is released from the upper chamber UC as the fluid discharges through the flush valve body 170 (from the top opening 180 to the lower opening 164), past the helical blades 230, and through the discharge outlet 78. As fluid is released from the upper chamber UC, the pressure in upper chamber UC (above the muffler portion 90 and the flush valve 92) is reduced and falls below the pressure within the main chamber MC of the pressure tank 74. The pressure above muffler portion 90 and the flush valve 92 falls below the pressure within pressure tank 74 because the volume of fluid that is discharged through the tank discharge is greater than the volume of fluid that enters upper chamber UC from the remainder of the pressure tank 74. The fluid released through outlet 78 flows into the china housing (not shown) and eventually through a drain passageway into the water closet bowl. The flow of water past the helical blades 230 will impart a swirling effect (vortex) within the flowing water, as discussed in greater detail below.

The pressure of water within the pressure tank 74 main chamber MC is then greater than the pressure within the upper chamber UC will cause water to flow from the tank 74 toward upper chamber UC. As the water flows toward upper chamber UC, a first portion of the water will pass between the jacket 100 and the upper muffler portion 112, and a second portion of the water will pass between the lower muffler portion 110 and the flush valve 92. The annular gaps between the jacket 100 and the lower muffler portion 110, and the lower muffler portion 110 and the flush valve 92 are small enough such that the rising water, moving in the direction of the arrow U, will lift the muffler portion 90 and the flush valve 92 toward the configuration seen generally in FIG. 5. That is, as water moves into the upper chamber UC from the main chamber MC, the water will flow past the lower flange 156 and the upper flange 158 of the upper muffler portion 112 (flow path P4 of FIG. 4) and urge (at least partially due to the friction between the water and the muffler portion 90) the muffler portion 90 generally in the direction of the arrow U. Further, the pressure in the upper chamber UC is maintained lower than the pressure in the main chamber for a sufficient amount of time to permit the muffler portion 90 to lift generally in the direction of the arrow U.

In one embodiment, the flow of water through the flow path P3 of FIG. 5 may lift the flush valve 92, although in other embodiments, the flush valve 92 will lift with the muffler portion 90, and the flush cartridge 82 may never be in the configuration of FIG. 5 during a flush.

After the muffler portion 90 and the flush valve 92 rise, the seal 168 unseats from discharge outlet 78, thereby permitting water from pressure tank 74 to escape through discharge outlet 78 past the seal 168 (through the second flow path P2). Water discharging between the seal 168 and the discharge outlet 78 will maintain the flush valve 92 generally in the configuration of FIG. 6, although the muffler portion 90 and the flush valve 92 may move axially during a flush. After the majority of water within pressure tank 74 has discharged through discharge outlet 78, thereby reducing the pressure within the main chamber MC of the pressure tank 74, the muffler portion 90 and the flush valve 92 move generally in the direction of the arrow D due to the force of gravity and seal 168 reseats on discharge outlet 78. The lower portion 162 is interposed radially within the surface 86 and ensures that the flush valve 92 remains generally centered within the surface 84 for proper seating and sealing with the surface 84. As pressure tank 74 refills, pressure within the main chamber MC of the pressure tank 74 increases, thereby ensuring a proper seat between seal 168 and the discharge outlet 78, and the stem sealing portion 206 unseats from the stem sealing surface 186. Since upper chamber UC is always in fluid communication with the remainder of the interior of the tank 74, the pressure within the tank 74 (25 psig in this example) will be the pressure within the upper chamber UC.

The flow paths P1, P2, P3, P4, are restricted when compared to the flow between the seal 40 and the discharge outlet 28 of the prior art flush valve cartridge 36. Further, the third annular gap 260 provides a smaller flow area than the flow path between the seal 40 and the discharge outlet 28 of the prior art flush valve cartridge 36. The flow of fluid through multiple flow paths, such as the flow paths P1, P2, P3, P4, may permit the water flowing from the main chamber MC to the discharge outlet 78 to flow through multiple paths, as differentiated from the prior art flush valve cartridge 36, where flow during the majority of a flush is generally between the seal 40 and the discharge outlet 28.

Additionally, in one embodiment, since the flush cartridge 82 lacks the top flange 42, the muffler portion 90 will not lift as easily as the prior art flush valve cartridge 36. This 'slower' lifting of the flush valve 92 reduces the noise generated during the flush. The expanded portion 214 reduces the initial flow through the flush valve 92, thereby increasing the time required to lift the flush valve 92 to permit flow through the second flow path P2.

As will be appreciated, a balance exists between the flow rates described herein and the dimensions of the apertures of the flush cartridge 82. For example, increasing the diameter of the lower opening 154 may result in the flush valve 92 closing faster.

As the water enters the toilet bowl raceways, the vortex imparted into the flow by the helical blades 230 reduces cavitation. The pressure is also reduced due to the increased area of the bowl's inlet, which is adjacent the discharge outlet 78. At least the combination of these factors results in reduced flow noise. The vortex (swirling) flow is quieter than linear water flow. The vortex flow through the inner raceway areas of the bowl (not shown) reduces noise associated with normal pressurized water flow through a pressure assisted toilet bowl. A more detailed discussion of the vortex flow is contained in pending patent application Ser. No. 11/156,718, the disclosure of which is incorporated by reference in its entirety.

FIGS. 9-13 and 16 illustrate test results using a Gerber Ultra Flush® bowl. The tests were initiated with about 50 psig in a flushometer tank and sound level readings were taken for at least 10 seconds prior to and after the initiation of each flush.

Figure 9:
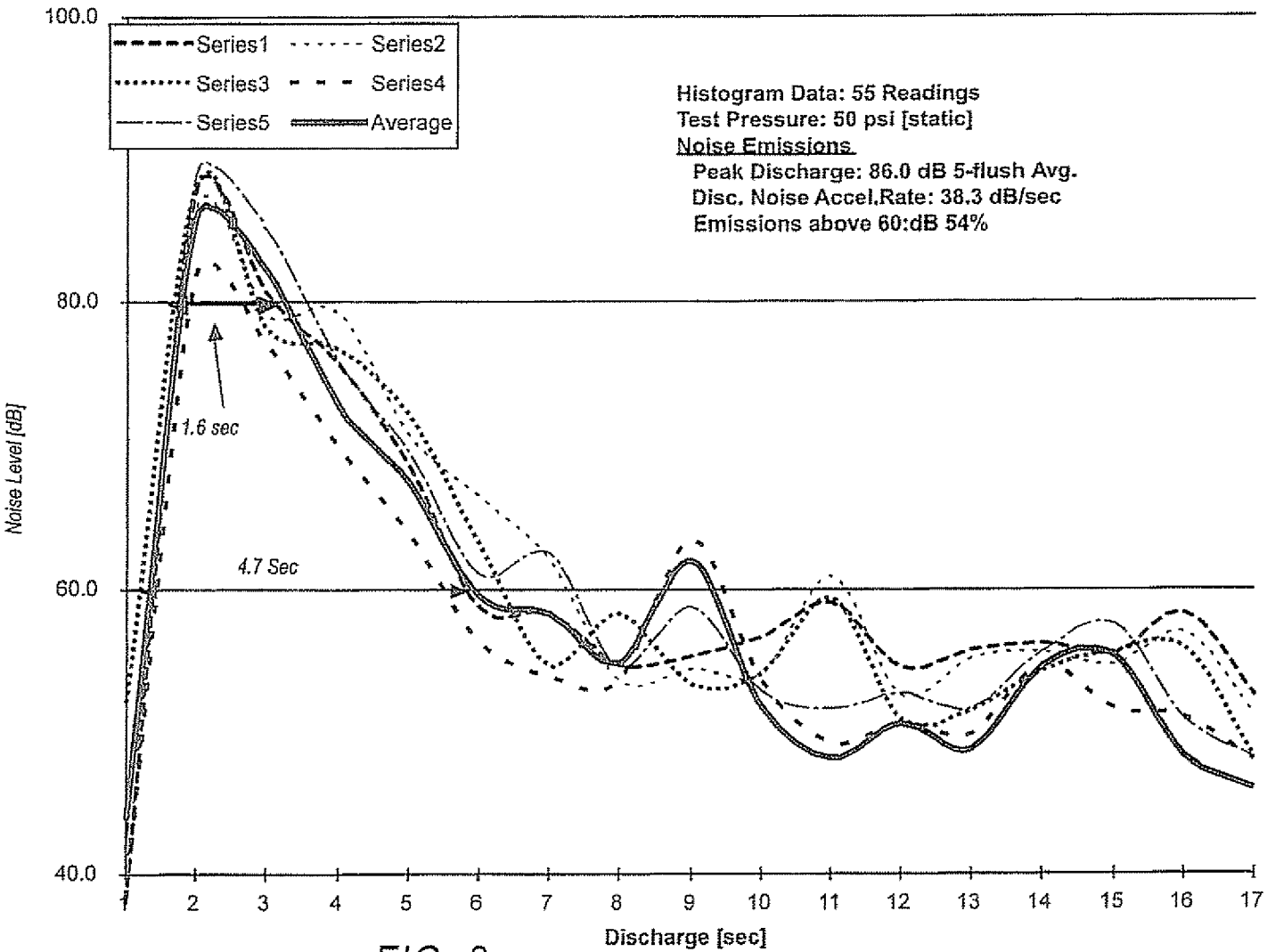
FIG. 9 is a graphical depiction of the noise emission over time of a flush cartridge test.
Figure 10:
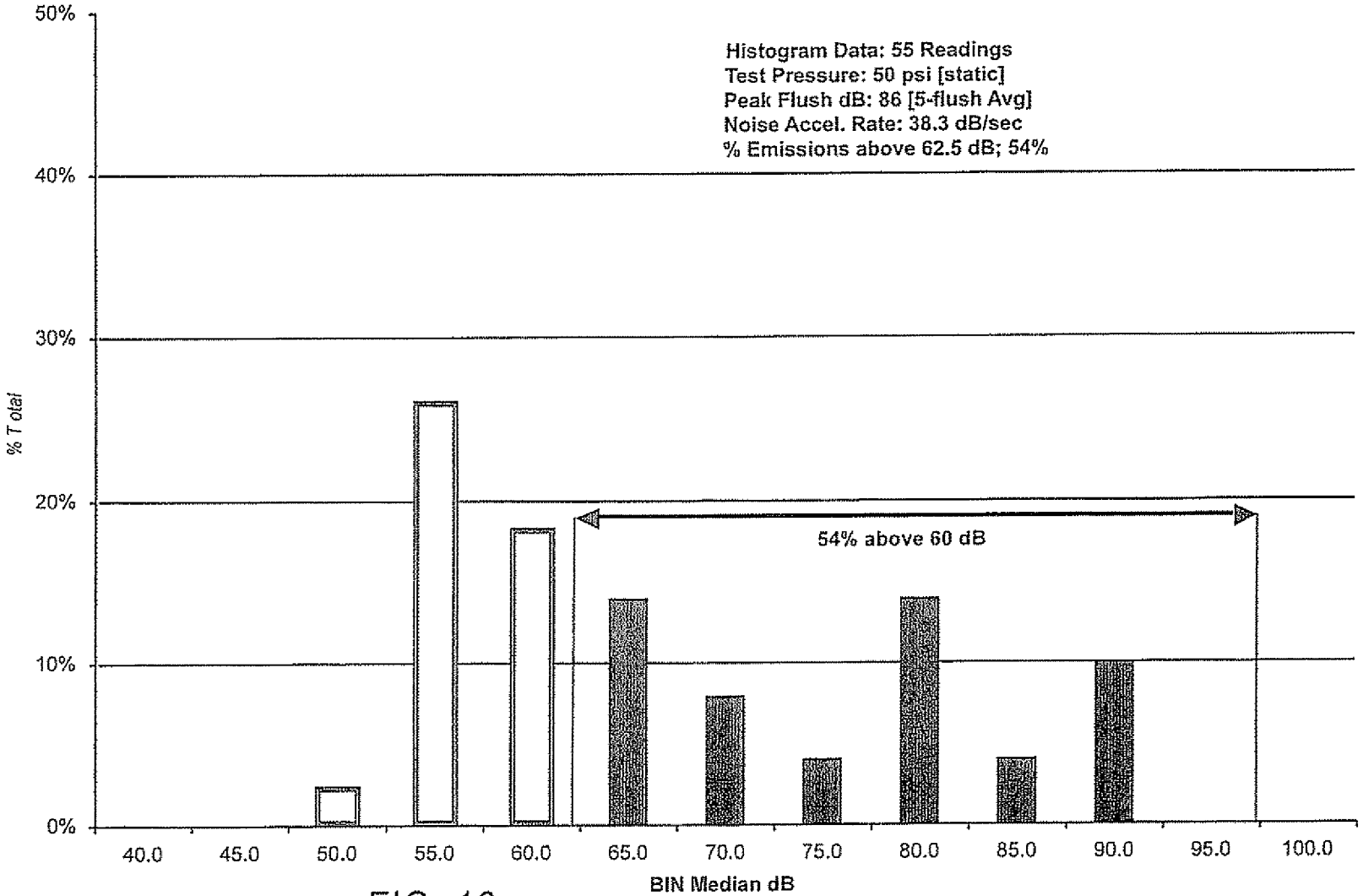
FIG. 10 is a histogram graphical depiction of the noise emission of FIG. 9.

FIGS. 9 and 10 illustrate a test of a prior art flush valve, such as the valve of U.S. Pat. No. 4,233,698, showing the averaged results from 5 tests. In the results of the tests illustrated in FIG. 9, the time from initiation until peak noise emission was about 2.4 seconds while the peak discharge noise was about 89.2 decibels (dB) and the flush noise above 60 dB lasted for about 11.1 seconds. The threshold of 60 dB has been selected as a discomfort threshold. The noise emission above the discomfort threshold of 60 dB was about 53 percent of the total noise emitted, as illustrated in FIG. 10.

Figure 11:
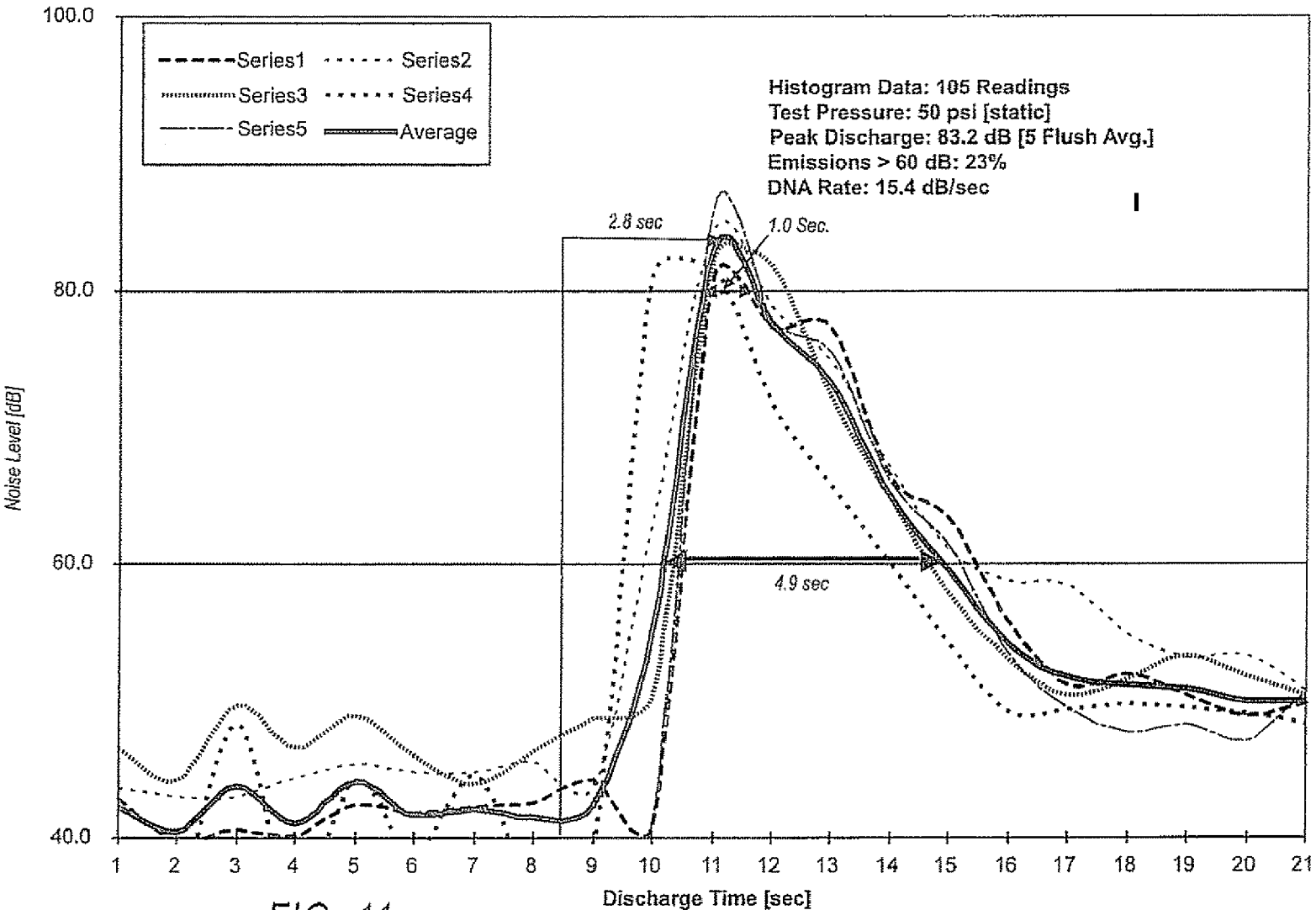
FIG. 11 is a graphical depiction of the noise emission over time of a flush cartridge in a flushometer tank test.
Figure 12:
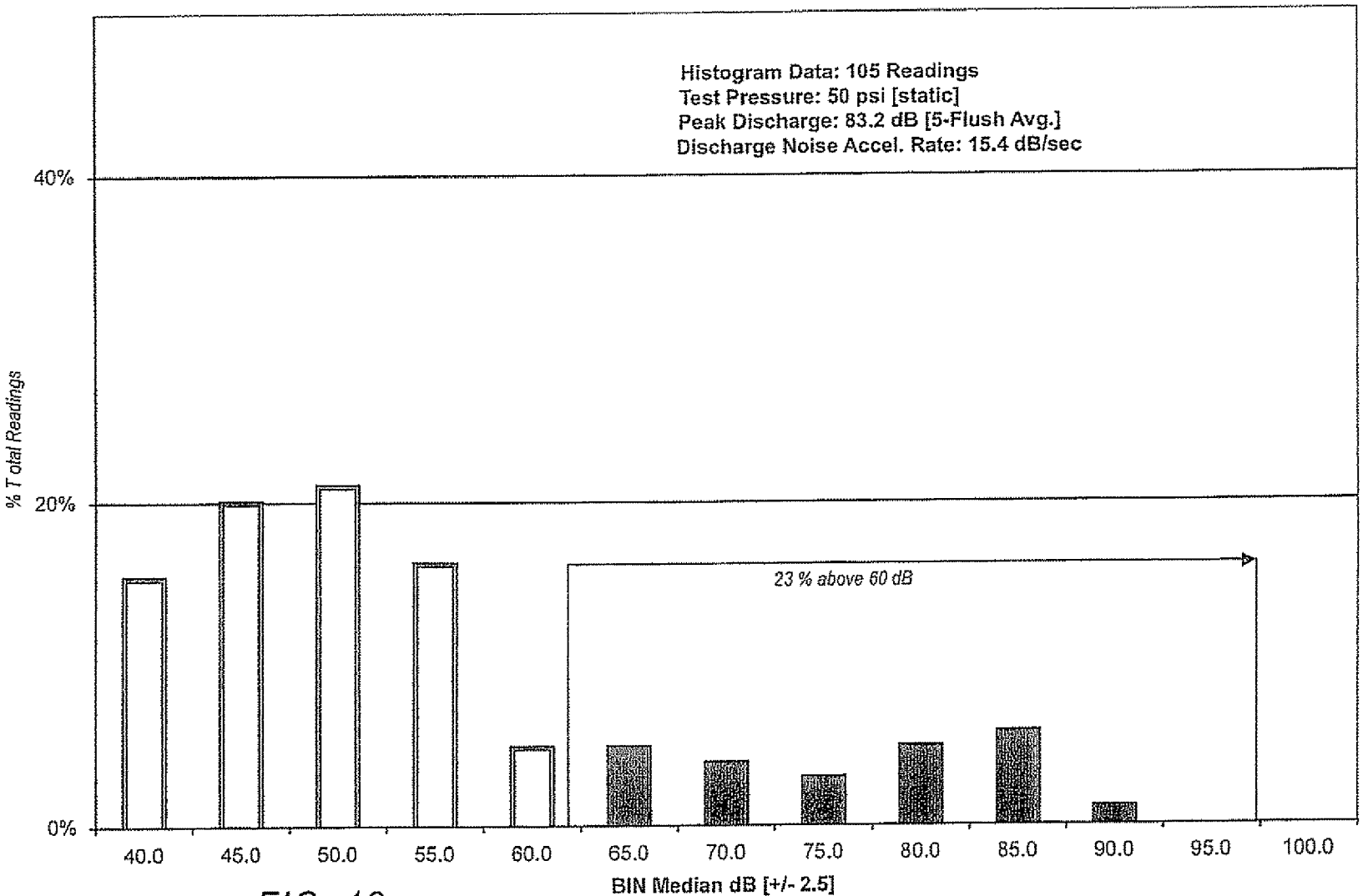
FIG. 12 is a histogram graphical depiction of the noise emission of FIG. 11.

FIG. 11 illustrates a test of an embodiment of the flush cartridge 82, showing the averaged results from 5 tests. In the results of the tests illustrated in FIG. 11, the time from initiation until peak noise emission was about 3.4 seconds while the peak discharge noise was about 83.9 dB and the flush noise above 60 decibels (dB) lasted for about 4.9 seconds. The noise emission above the discomfort threshold of 60 dB was about 22 percent of the total noise emitted, as illustrated in FIG. 12. Accordingly, a flush valve, such as the flush cartridge 82 may reduce the overall noise level during a flush, primarily at flush initiation. However, bowl tolerances and hydraulic designs (i.e. using a bowl design other than the standard Gerber Ultra Flush™) may affect the overall noise levels during a flush.

Figure 13:
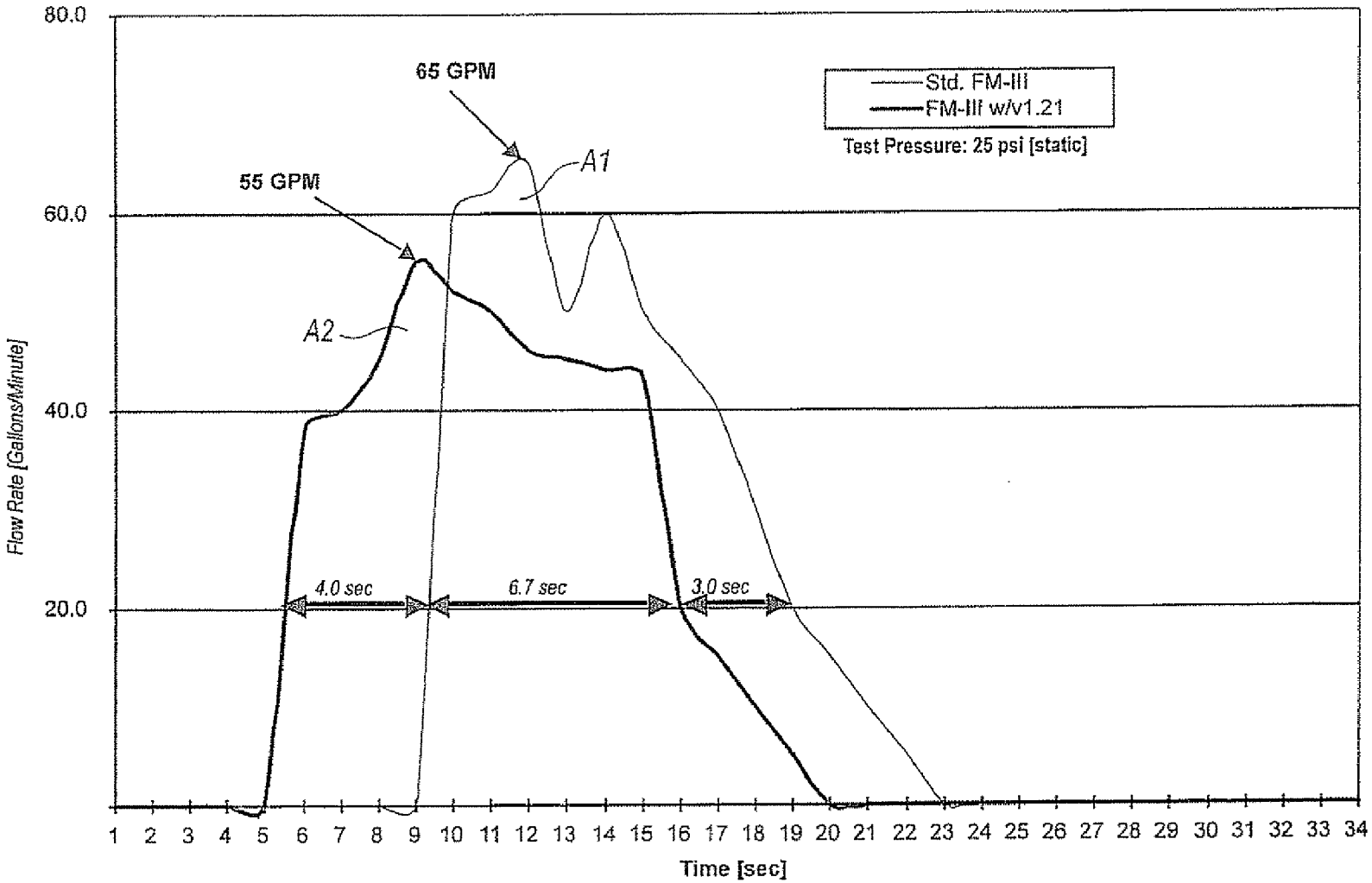
FIG. 13 is a noise emission comparison of test results of a pressure assisted flush system using a prior art flush cartridge and an embodiment of a flush cartridge.

As best seen in FIG. 13, a prior art flush valve, such as the flush valve disclosed in U.S. Pat. No. 4,233,698, permits an initial spike in discharge flow that results in a maximum discharge flow of about 65 gallons per minute (gpm) within about 3.5 seconds after flushing, while an exemplary test specimen in accordance with an embodiment results in a maximum discharge flow of about 55 gpm within just under about 5 seconds after flushing, although differing bowl designs may produce differing results. For extraction capability, the flow rate of the exemplary test specimen in accordance with an embodiment is above 20 gpm for about 10.7 seconds, while the flow rate of the prior art flush valve is above 20 gpm for about 9.7 seconds. Both test specimens extracted 100% of the ANSI/ASME Standard A112.19.2 balls and the MaP (Veritec) Standard grams.

As an example of the extraction capacity of the test specimens of FIG. 13, the area A1 of the graph above 20 gpm for the Standard FM-III may be compared to the area A2 of the graph above 20 gpm for the v 1.21. As illustrated, the area A1 is about equal to the area A2. That is, the flow rate through the discharge outlet 28, 78 averaged per unit time is about the same for both specimens. Accordingly, the force of the water flowing through the bowl for each specimen is comparable, although the v 1.21 specimen, generally illustrated in FIGS. 14 and 15, requires a lower maximum flow rate to achieve the same results. Further, the v 1.21 test specimen sustained a flow rate above about 40 gpm for a longer amount of time than the Standard FM-III test specimen. (As an example, the maximum flow rate through the pressure tank outlet is greater than about 40 gallons per minute for more than about 7 seconds.) This sustained flow rate is believed to be at least a contributing factor to the extraction capability comparison presented in FIG. 18.

Another comparison of the extraction capacity of the test specimens of FIG. 13 is to consider the pressure within the tanks 24, 74 during a flush. As the Standard FM-III releases water through the discharge outlet 28, the flow rate through the discharge outlet 28 causes the pressure within the tank 24 to be reduced. This reduction in pressure permits the flush valve 38 to close and the pressure will rise as the tank 24 is refilled. In contrast, as the v 1.21 releases water through the discharge outlet 78, the flow rate through the discharge outlet 78 causes the pressure within the tank 74 to be reduced, but the reduction in pressure is delayed (when compared to the Standard FM-III) due to the reduced flow rate illustrated in FIG. 13. Accordingly, the pressure behind the discharge in the v 1.21 specimen is greater through a portion of the flush (most significantly, generally between about 2 seconds after initiation of flush and 10 seconds after initiation of flush). That is, a lower flow rate results in a higher sustained pressure. This "power push" of water through the bowl during the period of greater sustained pressure for the v 1.21 specimen is believed to be a contributing factor to the results presented herein.

The peak of the noise of the prior art flush valve of FIG. 9 as a result of the opening of the prior art flush valve is about 2.4 seconds, while the reduced peak noise of the exemplary flush valve of FIG. 11 may be the result of the opening of the prior art flush valve is about 3.2 seconds. That is, the increase in noise per unit time (DNAR) of the prior art valve is about 16.9 dB/s (decibels per second) while the increase in noise per unit time (DNAR) of the exemplary flush valve of FIG. 11 is about 13.3 dB/s.

Figure 14:
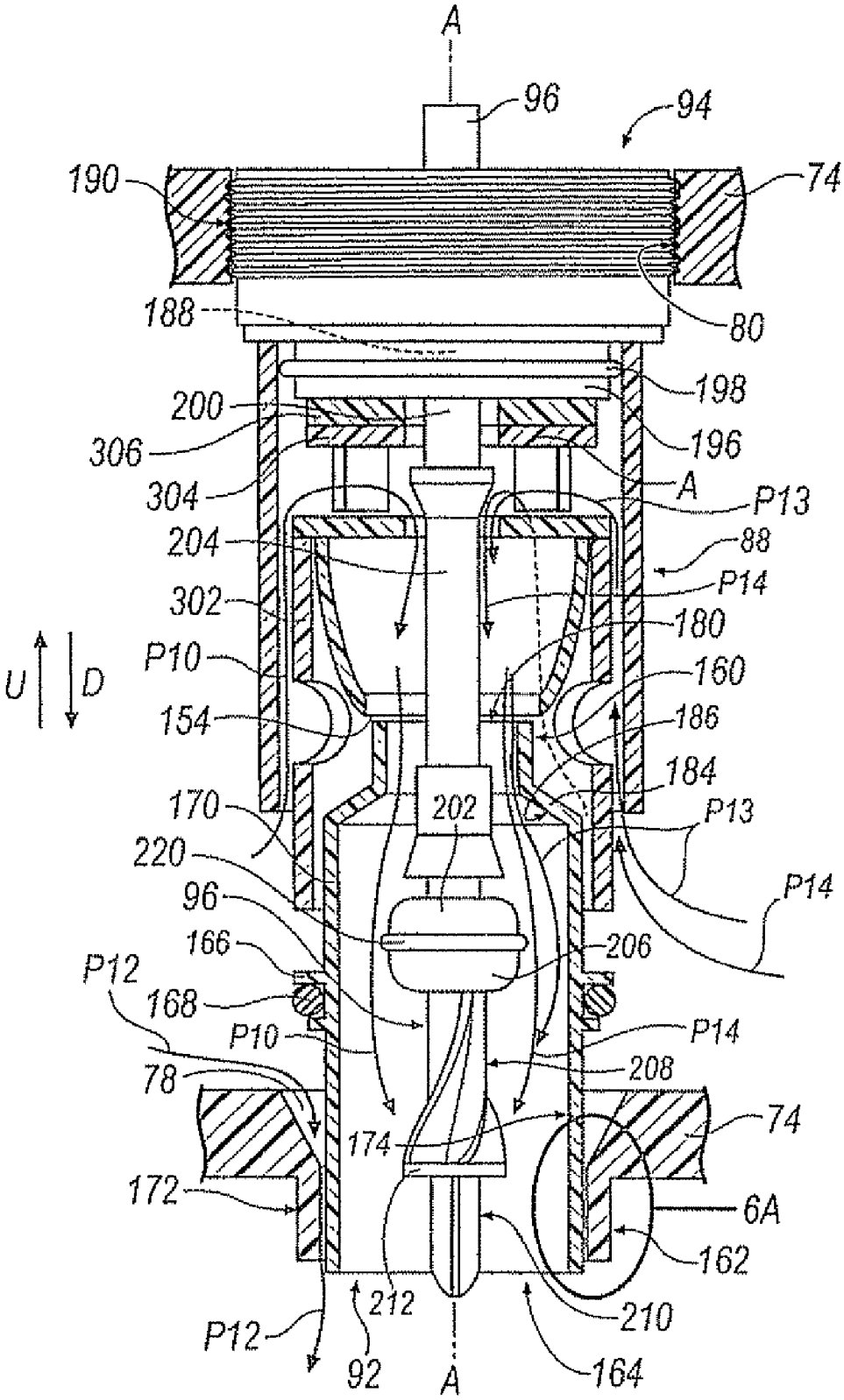
FIG. 14 is an enlarged partial sectional elevation view of a flush cartridge.
Figure 15:
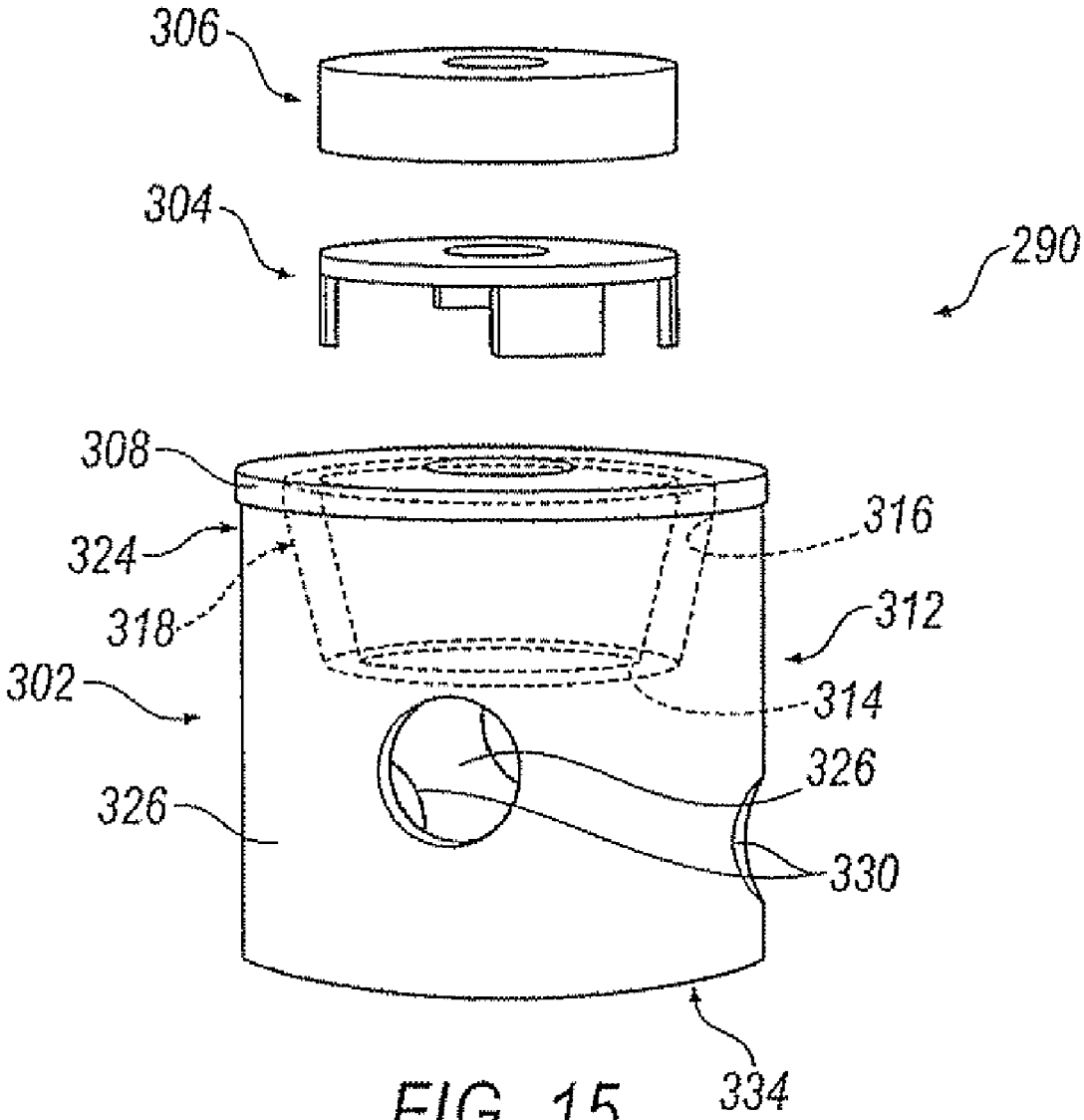
FIG. 15 is an exploded perspective view a portion of the flush valve of FIG. 14.

FIGS. 14 and 15 illustrate another embodiment of the muffler portion 90 as a muffler assembly 290. In one embodiment, the muffler assembly 290 includes a first muffler portion 300, a second muffler portion 302, and a third muffler portion 304. Although FIGS. 14 and 15 illustrate the muffler assembly 290 as having three distinct components, any two of the three portions 302, 304, 306 may be made essentially integral.

The first muffler portion 302 includes a first lip 308, an inner muffler portion 310 and a generally cylindrical hollow muffler body 312. The inner muffler portion 310 includes a lower opening 314, an upper opening 316, and a curved body portion 318 extending therebetween. The muffler body 312 includes a lower end 322, an upper end 324, an outer surface 326, and inner surface 328, a plurality of apertures 330 formed between surfaces 326 and 328, and a lower muffler opening 334. The first lip 308 includes an upper surface 340, a lower surface 342, a generally cylindrical outer surface 346, and an aperture 348.

The second muffler portion 304 includes a second lip 360, and a plurality of axially extending body portions 362 extending therefrom. The second lip 360 includes an upper surface 370, a lower surface 372, a generally cylindrical outer surface 376, and an aperture 378. Each body portion 362 includes a first end 380 connected to the lower surface 372, a second end 382, a first body surface 384, a second body surface 386, an outer body surface 388, and an inner body surface 390.

The third muffler portion 306 includes an upper surface 400, a lower surface 402, an outer surface 404, and an inner surface 406 defining an aperture. As illustrated, the third muffler portion may maintain a desired spacing between the top cap 94 and the upper surface 370 of the second muffler portion 304. That is, the third muffler portion 306 may be used for limiting the axial movement of at least the second muffler portion 304 as the muffler assembly 290 moves axially toward the top cap 94.

The body portions 362 are circumferentially spaced defining apertures 410 therebetween. Specifically, four apertures 410 are illustrated in FIGS. 14 and 15 that define 4 distinct flow paths therethrough from the first annular gap 240 through the upper opening 316.

Figure 16:
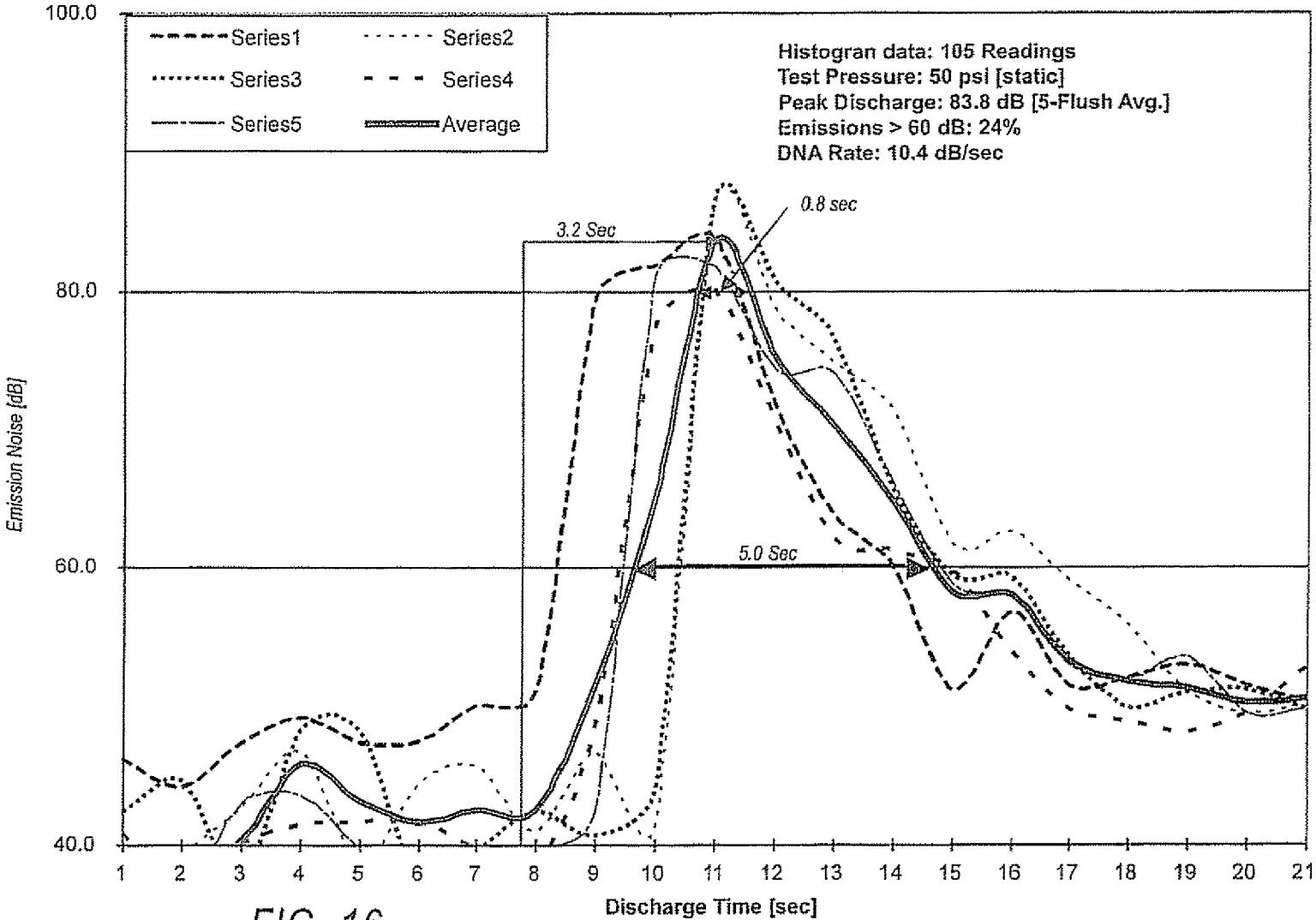
FIG. 16 is a graphical depiction of the noise emission over time of a flush cartridge test.
Figure 17:
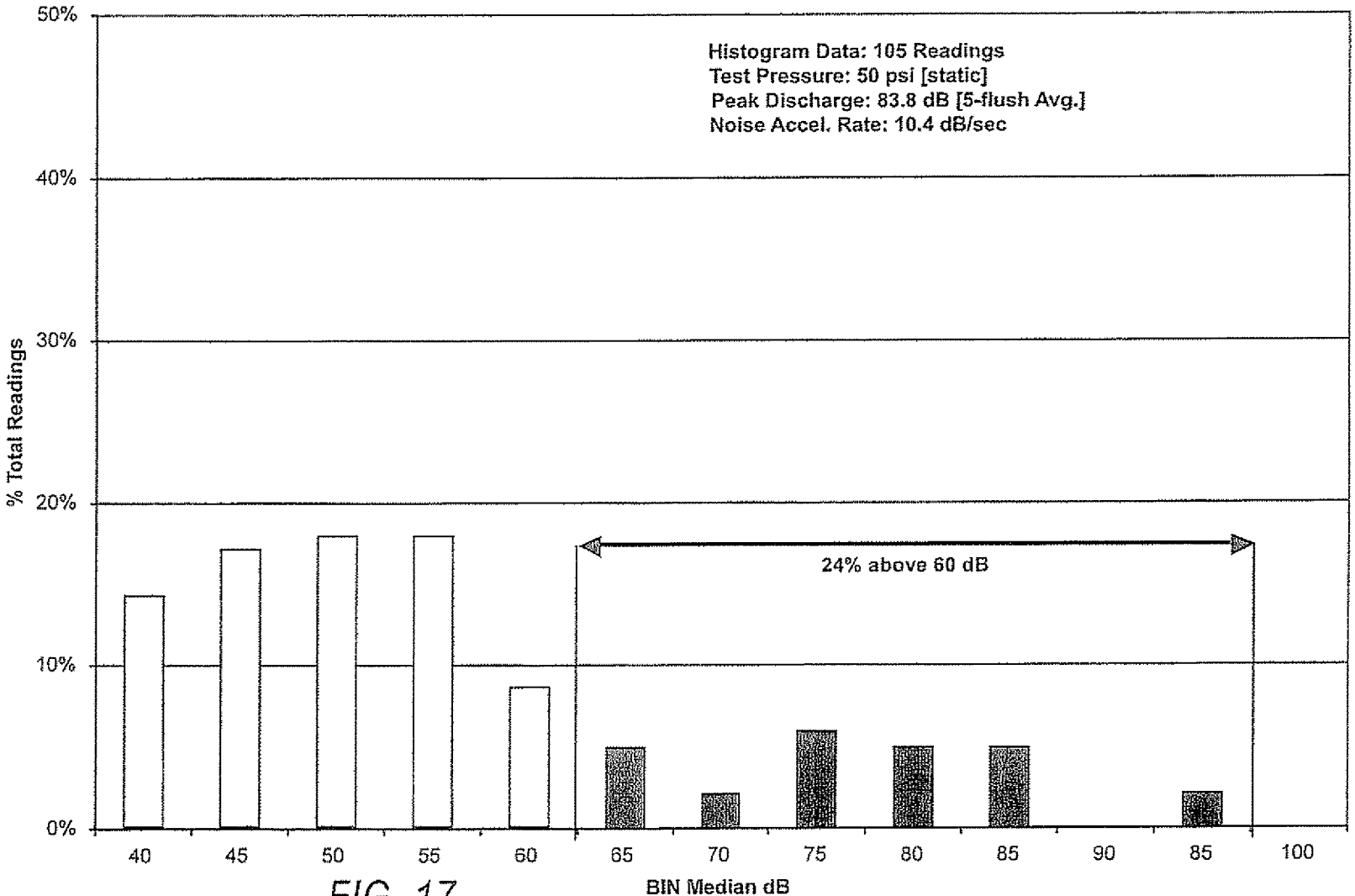
FIG. 17 is a histogram graphical depiction of the noise emission of FIG. 16.

FIG. 16 illustrates a test of an embodiment of the flush cartridge 82 with the muffler assembly 290 interposed therein as shown in FIGS. 14 and 15. The averaged results from 5 tests are illustrated. In the results of the tests illustrated in FIG. 16, the time from initiation until peak noise emission was about 3.3 seconds while the peak discharge noise was about 76.4 dB and the flush noise above 60 decibels (dB) lasted for about 6.8 seconds. The noise emission above the discomfort threshold of 60 dB was about 24 percent of the total noise emitted, as illustrated in FIG. 17.

Figure 1:
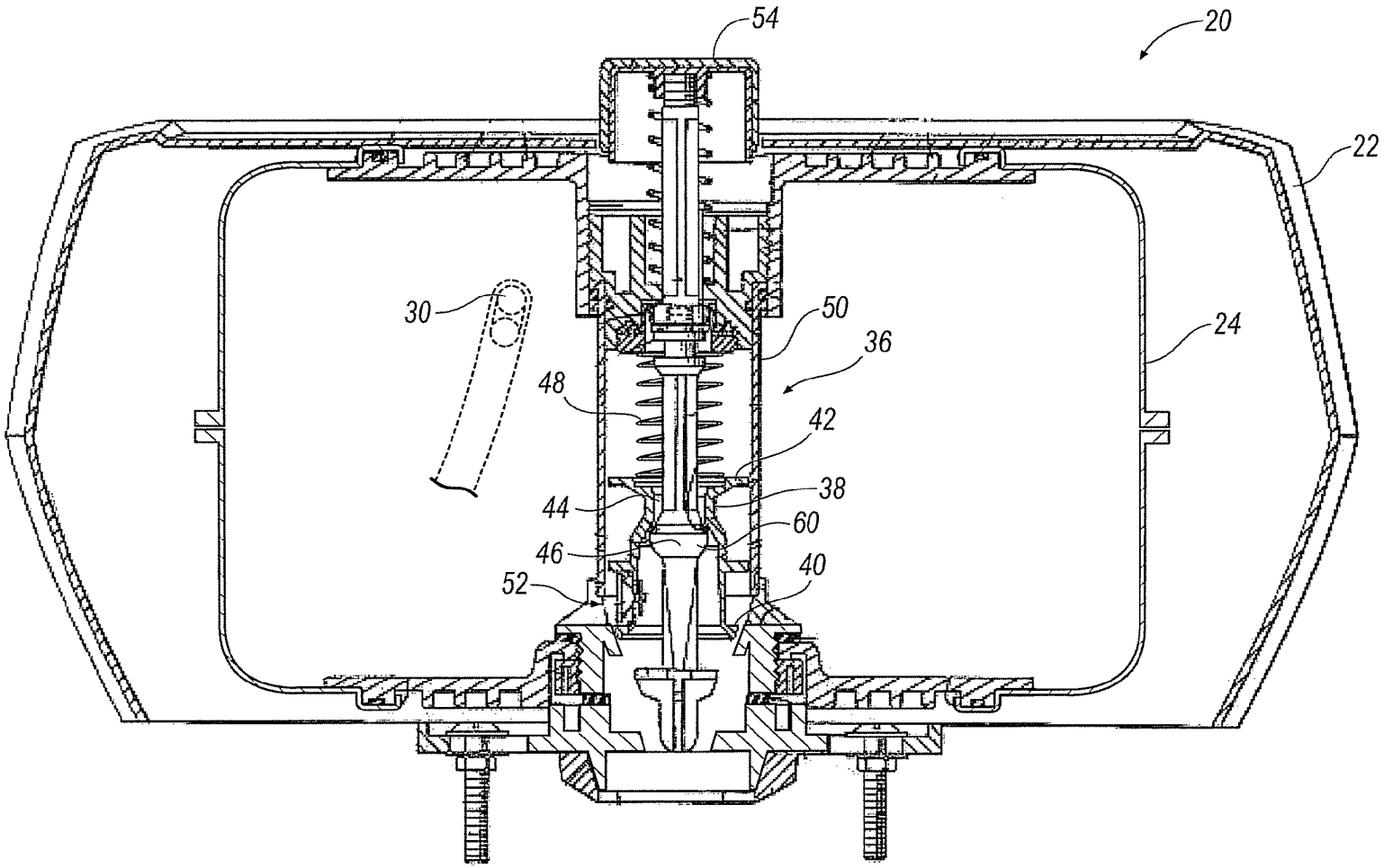
FIG. 1 PRIOR ART
FIG. 1 is a partial sectional elevation view of a pressure assisted flush system including a flush cartridge.

FIG. 18 illustrates a comparison of the tests of FIGS. 9, 11, and 16. Generally, these tests are representative of the prior art flush cartridge of FIG. 1, the flush cartridge of FIG. 2, and the flush cartridge of FIG. 14, respectively. Surprisingly, a comparison of the time to reach the peak noise level of the differing specimens reveals that the time to reach the peak noise level during the test of the Standard FM-III was 1.2 seconds, while the time to reach the peak noise level during the test of the v 1.10 was 2.8 seconds and the time to reach the peak noise level during the test of the v.1.21 was 3.2 seconds. This rate of increase of noise comparison reveals that the v 1.21 has about a 60% reduction in rate of increase of noise (15.4 dB/s vs. 38.3 dB/s) and the v 1.10 has about a 73% reduction in rate of increase of noise (10.4 dB/s vs. 38.3 dB/s).

Further, FIG. 18 (and FIGS. 10, 12, and 17) reveals that the Standard FM-III amount of time during the flush that noise was greater than 60 dB was 54%, while the v 1.10 amount of time during the flush that noise was greater than 60 dB was 23%, while the v.1.21 amount of time during the flush that noise was greater than 60 dB was 24%.

The embodiments presented herein eliminate the need for a biasing member, such as the flush valve spring 48 of the prior art flush valve cartridge 36. The embodiments also reduce the rate of increase of noise, which may be considered a comfort factor in selecting a flush valve.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. An apparatus for initiating a flush of a pressure assisted toilet, comprising:

a housing having a top end, a bottom end, and a housing internal surface and generally defining an axis;

a flush valve at least partially interposed within the housing and having a generally cylindrical hollow body with a top opening, a sealing portion, and a lower extension defining a lower opening, wherein the flush valve will selectively move axially relative to the housing;

a muffler portion at least partially interposed within the housing and having a plurality of apertures formed therein, wherein the muffler portion will selectively move axially relative to the housing;

wherein the muffler portion is positioned above the flush valve, and a first flow path selectively defined by the apparatus and extending at least from the bottom end of the housing, then through at least one of the plurality of apertures formed in the muffler portion, then through the lower opening of the first member, and through a pressure tank outlet to provide a reduced peak flow rate.

2. The apparatus of claim 1, further comprising a stem portion extending at least partially through the muffler portion and the flush valve, wherein the stem portion includes a sealing portion for selectively sealing with the flush valve.

3. The apparatus of claim 1, wherein the flush valve that further comprises a flush valve seal that is selectively in sealing contact with the pressure tank outlet.

4. The apparatus of claim 1, wherein a fluid generally follows the first flow path upon the initiation of a flush of the pressure assisted toilet, and the fluid flows through a plurality of distinct flow paths after the flush valve moves axially relative to the housing.

5. The apparatus of claim 4, wherein at least a plurality of the plurality of flow paths flow through apertures formed within the muffler portion.

6. The apparatus of claim 1, wherein at least a portion of the lower extension selectively extends through the pressure tank outlet during an entire flush.

7. The apparatus of claim 1, further comprising a tank, wherein at least a portion of the mechanism is interposed within the tank, and wherein the tank selectively contains a fluid pressurized above atmospheric pressure.

8. The apparatus of claim 1, wherein the muffler portion includes a first portion having an upper aperture and a second portion having a plurality of body portions extending therefrom that selectively contact the first portion.

9. The apparatus of claim 8, wherein the muffler portion includes a third portion for limiting the axial movement of at least the second portion.

10. A method of reducing noise associated with a toilet discharge outlet comprising:

forming a first member seating portion on a first member of a flush valve cartridge, wherein the seating portion will selectively seal with a pressure tank outlet;

positioning the first member adjacent a second member such that the second member is positioned above the first member, wherein the second member includes a plurality of apertures;

positioning the first member and the second member at least partially within a housing such that the first member and the second member are selectively axially moveable relative to the housing;

providing a first flow path through at least a through a first aperture formed within the second member, providing a second flow path through a second aperture formed within the second member, providing a third flow path through a third aperture formed within the second member, wherein at least a portion of a fluid will selectively simultaneously flow through the first flow path, the second flow path, and the third flow path to provide a reduced peak flow rate.

11. The method of claim 10 wherein the first member is selectively axially moveable relative to the second member.

12. The method of claim 10, wherein the second member includes a first portion having an upper aperture and a second portion having a plurality of body portions extending therefrom that selectively contact the first portion.

13. The method of claim 10, further comprising interposing a stem portion within the housing such that at least a portion of the fluid flow through the first flow path, the second flow path, and the third flow path will flow past and in contact with at least a portion of the stem portion.

14. The method of claim 13, wherein the stem portion will selectively seal with at least a portion of one of the first member and the second member.

15. The method of claim 10, further comprising at least one helical portion formed within the first flow path, wherein the helical portion is coupled to at least one of the stem portion and the first portion for imparting a swirling effect on at least a portion of the fluid of the first flow path.

16. The method of claim 15, wherein at least a portion of the flow of water through the discharge outlet does not pass between the helical portion and the first member.

17. The method of claim 10, further comprising providing a main flow path between at least a portion of the first portion and the pressure tank outlet.

18. The method of claim 10, wherein the maximum decibel rate of increase is less than about 20 decibels per second.

19. The method of claim 10, wherein the maximum flow rate through the pressure tank outlet is greater than about 40 gallons per minute for more than about 7 seconds.

20. The method of claim 10 wherein the maximum amount of noise above about 60 decibels is less than about 30% of the total time that a fluid is flowing through the pressure tank outlet.

21. The apparatus of claim 1, wherein at least a portion of the first member will selectively move relative to at least a portion of the second member.

* * * * *

UNITED STATES PATENT AND TRADEMARK OFFICE

CERTIFICATE OF CORRECTION

PATENT NO. : 7,617,545 B2
APPLICATION NO. : 11/957179
DATED : November 17, 2009
INVENTOR(S) : R. B. Martin It is certified that error appears in the above-identified patent and that said Letters Patent is hereby corrected as shown below:

In the Claims:

Column 11, line 12, delete "a through"

Signed and Sealed this

Twelfth Day of January, 2010

David J. Kappos

David J. Kappos
*Director of the United States Patent and Trademark Office*